United States Patent [19]

Albee, Jr.

[11] 3,958,499

[45] May 25, 1976

[54] NEWSPAPER LOG MAKER

[75] Inventor: Percy Frederick Albee, Jr., Barrington, R.I.

[73] Assignee: Q-Panel Corporation, Providence, R.I.

[22] Filed: Jan. 6, 1975

[21] Appl. No.: 538,595

[52] U.S. Cl. ..... 93/1 C; 44/2; 93/81 R; 100/76; 242/67.1 R

[51] Int. Cl.[2] ..... B31C 13/00; C10L 5/40

[58] Field of Search ..... 93/1 C, 77, 81 R; 242/67.1 R, 60; 44/2; 100/76

[56] References Cited

UNITED STATES PATENTS

| | | | |
|---|---|---|---|
| 437,554 | 9/1890 | Bellamy | 242/60 |
| 527,365 | 10/1894 | Crabtree | 242/60 |
| 2,350,758 | 6/1944 | Heuer | 242/67.1 R |
| 3,830,441 | 8/1974 | McQuiston | 242/67.1 R |

OTHER PUBLICATIONS

Logger Industries Order Form, 1972.

*Primary Examiner*—James F. Coan
*Attorney, Agent, or Firm*—Barlow & Barlow

[57] ABSTRACT

A device for rolling newspapers or the like that consists of a framework having a pair of vertical standards with bearing means at their upper end through which a crank arm with an elongated shank portion may be inserted. A package of newspapers may be draped over the shank portion of the crank and then clamped in position on the shank and the crank turned whereupon a rolled section of newspapers is formed that may be wrapped and tied into place, and then by removal of one pin of the clamp the entire package may be slipped off the shank.

3 Claims, 5 Drawing Figures

NEWSPAPER LOG MAKER

BACKGROUND OF THE INVENTION

It has been proposed heretofore to roll newspapers for fireplace use and construct what is commonly referred to as a newspaper log. The prior art on this type of device has utilized a crank with an elongated shank and has this crank rotating in a trough. Newspapers would be placed in the trough and the crank turned but the use of the trough device creates substantial sliding friction of the newspapers in the trough itself and is not feasible for one to use without exerting more strength than is practical under the circumstances.

SUMMARY OF THE INVENTION

This invention relates to a machine for device for rolling newspapers into log formation and simply comprises a pair of vertical standards having bearing means at their upper ends through which the shank of the crank member may be received. The particular clamp means is in the form of a bar having pin engagement with the shank, the pin engagement occurring at the inner and outermost ends of the shank to permit a wide area for the newspaper package to be received thereon. Further this wide spacing permits the use of removable pin construction where, if the outermost pin is removed, the rolled-up newspaper package may be removed from the shank. It is the basic object of this invention to provide a simple and inexpensive machine constructed so that packages of newspapers may be readily rolled up thereupon and just as readily detached therefrom.

DESCRIPTION OF THE PREFERRED EMBODIMENT

Figure 1:
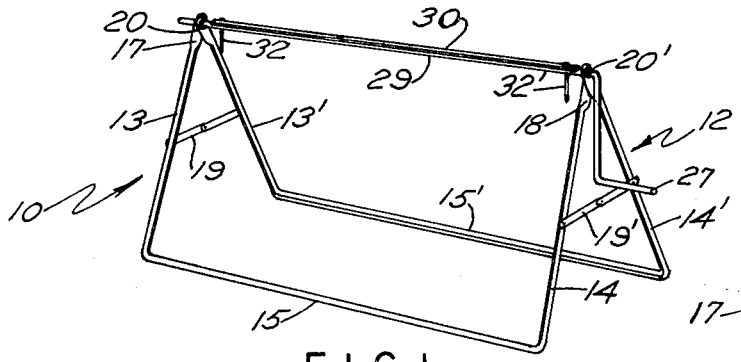
FIG. 1 is a perspective view showing the invention.

In the drawings, the preferred form of the device comprises a pair of U-shaped frames 10 and 12 which frames are composed of upright legs 13, 13′ and 14, 14′ and a bottom bar 15, 15′. The upper ends of the legs 3, 13′ are joined together in any suitable manner such as by a rivet-like grommet 20, 20′ which holds the upper ends together by flattened end portion 17 and 18. The upright sections 13, 13′, 14, 14′ are held spaced apart at an angle to each other by a pivoting bracket 19, 19′ and in this position provides a self-supporting stand, the legs 13, 13′ and 14, 14′ effectively acting as vertical standards, with bearing means being provided by the grommets 20, 20′ at the upper ends thereof.

Figure 3:
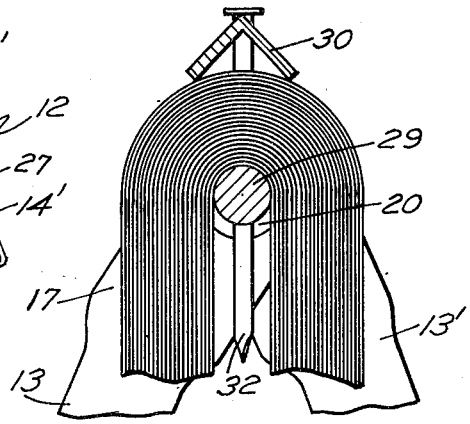
FIG. 3 is a sectional view on lines 3—3 of FIG. 2.
Figure 2:
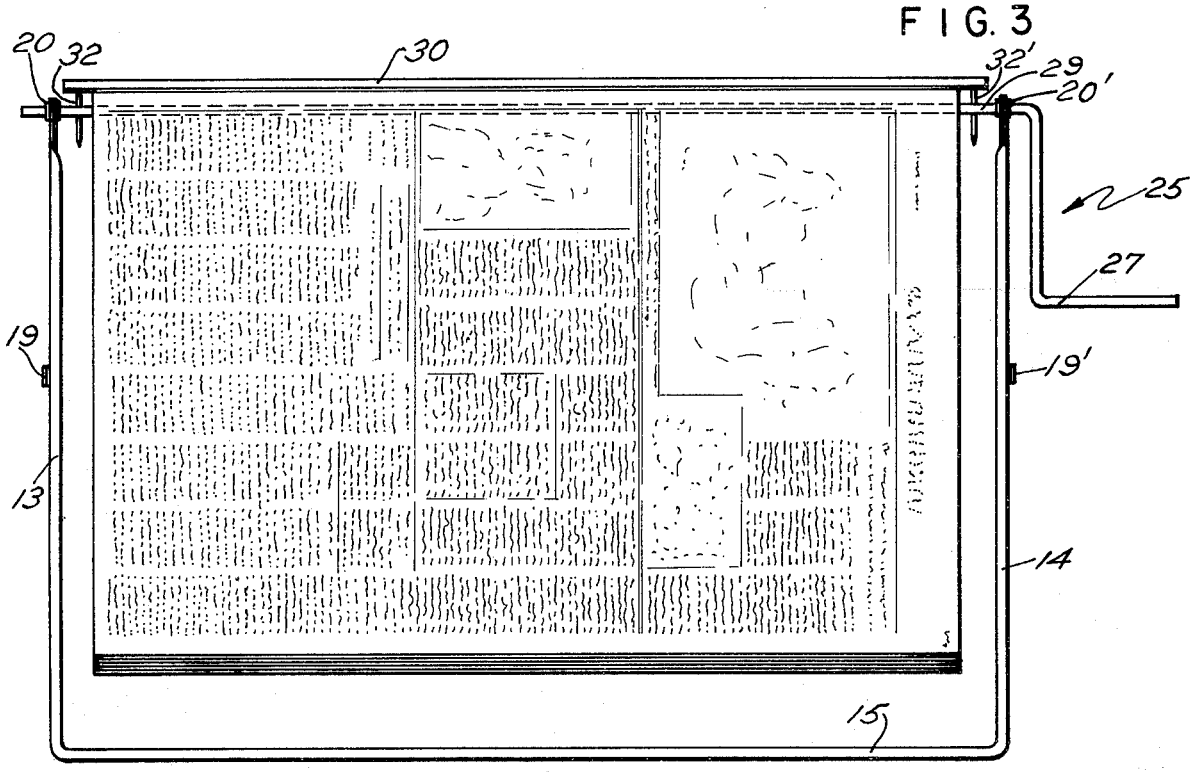
FIG. 2 is an elevational view with a pack of newspapers affixed to the device.
Figure 4:
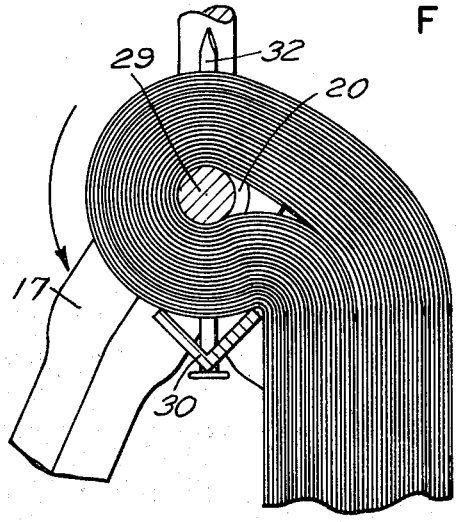
FIG. 4 is an illustrative sectional view similar to FIG. 3 showing the crank rotation 180°.
Figure 5:
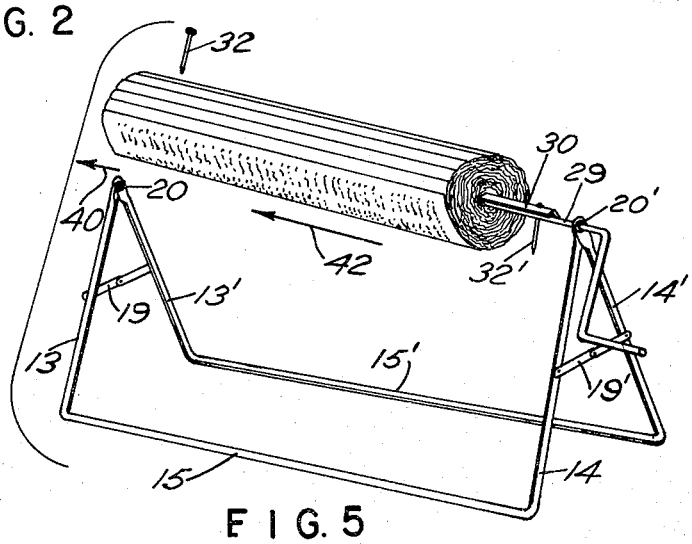
FIG. 5 is a diagrammatic perspective view showing the manner in which the newspaper roll may be removed.

Through the grommets 20, 20′ is inserted a crank means generally designated 25 which comprises a crank handle 27 with an elongated shank 29. A clamp is provided to cooperate with this shank, the clamp taking the form of an elongated bar 30, which bar as seen in FIGS. 3 and 4 may take an inverted V-shape. At either end of the bar is an aperture to receive a pin 32, 32′ and likewise through the shank 29.

I claim:

1. A device for rolling newspapers and the like comprising a pair of vertical standards having circular bearings at the upper ends, a crank arm having a main shank portion extending through each of said bearings, a clamp bar, removable means to removably secure said clamp bar on the shank portion of said crank arm to clamp material to the shank portion and to rotate therewith whereby the shank may be first fully loaded with all paper to be rolled and the clamp bar then used to clamp the paper to the shank and upon completion of rolling said removable means may be removed and the rolled paper may be axially moved off the shank.

2. A device for rolling newspapers and the like as in claim 1 wherein the shank portion is provided with spaced apertures and the clamp bar is provided with removable pins therethrough that pass through said apertures.

3. A device for rolling newspapers and the like as in claim 2 wherein the vertical standards have longitudinal bottom support bar therebetween to permit the upper ends to be sprung apart.

* * * * *